United States Patent [19]

Wood

[11] Patent Number: 4,752,781

[45] Date of Patent: Jun. 21, 1988

[54] SIDE-LOOKING AIRBORNE RADAR (SLAR) ANTENNA

[75] Inventor: Peter J. Wood, Nepean, Canada

[73] Assignee: Canadian Astronautics Limited, Ontario, Canada

[21] Appl. No.: 819,037

[22] Filed: Jan. 15, 1986

[30] Foreign Application Priority Data

Jan. 18, 1985 [CA] Canada ..... 472358

[51] Int. Cl.[4] ..... H01Q 13/10

[52] U.S. Cl. ..... 343/771; 343/872

[58] Field of Search ..... 343/771, 872

[56] References Cited

U.S. PATENT DOCUMENTS 4,517,571 5/1985 Mulliner et al. ..... 343/872

*Primary Examiner*—William L. Sikes
*Assistant Examiner*—Robert E. Wise
*Attorney, Agent, or Firm*—Parkhurst & Oliff

[57] ABSTRACT

A planar slotted waveguide antenna array having a front, radiating surface and a back-plane, a length dimension L and a width dimension W, comprising a plurality of radiating waveguides parallel to the width dimension; a plurality of co-planar radiating apertures in each of said plurality of radiating waveguides constituting said radiating surface; a feeder waveguide along at least part of the length dimension contiguous a predetermined edge of the array; and a plurality of coupling apertures for coupling microwave energy between said feeder waveguide and each of said plurality of radiating waveguides.

8 Claims, 3 Drawing Sheets

SIDE-LOOKING AIRBORNE RADAR (SLAR) ANTENNA

CROSS-REFERENCE TO RELATED APPLICATION

This application is related to concurrently filed, commonly assigned application by the same inventor entitled COMPOSITE WAVEGUIDE COUPLING APERTURE HAVING A THICKNESS DIMENSION which is incorporated herein by reference.

FIELD OF THE INVENTION

The present invention relates to antennas in general and in particular to planar slotted-waveguide array antennas. More particularly still, it relates to planar waveguide-fed slot-antenna arrays suitable for terrain-mapping side-looking airborne radar (SLAR) antennas.

BACKGROUND OF THE INVENTION

Using SLAR is an efficient, low-cost method of viewing and mapping terrains over a wide swath of territory on either side of the flight path of the carrier aircraft. Two SLAR antennas on either side of the aircraft illuminate a long, preferably narrow strip of the terrain with a high-powered short radar pulse, normally in the X-band of the microwave spectrum. As the radiated impulse power is reflected by the illuminated terrain and received by the now receiving SLAR antenna, the intensity and times of arrival of the reflections are processed electronically to produce an instantaneous terrain map. As the aircraft proceeds along its path the terrain map is updated. As an example a suitable radar pulse repetition frequency of 800 Hz could be used, with a pulse duration of approximately 250 nanoseconds. The quality of the terrain map depends strongly from the precision of the radiated illumination pattern. It is known in the art that a narrow beam in the horizontal plane (a so-called pencil beam in the azimuth plane) having its peak intensity along an axis perpendicular to the flight path and slightly inclined with respect to the horizontal plane, and illuminating the terrain with gradually declining intensity reaching a null underneath the flight path is required. Accordingly, the terrain is approximately uniformly illuminated irrespective of the distance from the antenna. A narrow beam in the horizontal plane is necessary in order to provide good azimuth resolution of the terrain of the strip just under the antenna as an illuminating radar pulse is emitted. Therefore, the far-field azimuth angle of the beam should be as small as possible, and the illumination intensity should decline from its peak at the near horizontal to the near vertical (downward from the aircraft) as uniformly as possible. These characteristics are, of course, desirable in any planar antenna array, and imply minimal side-lobe illumination.

PRIOR ART OF THE INVENTION

As may be seen from the above description, the antenna arrays used in SLAR applications are among those that are required to meet the strictest standards in manufacturing and performance. It is therefore not surprising that the closest prior art to the present invention is a SLAR antenna. Indeed, as will be seen later when describing the preferred embodiment, the latter was realized to physically fit into the same antenna radome.

The existing SLAR antenna comprises sixteen horizontal waveguides, in a single plane each of which is approximately seventeen feet long. The planar front surface of the waveguide array shows the slotted narrow side of the waveguides. The slots are what is known in the art as "edge-wall" slots. The array's waveguides are fed by a tree of T-splitters. As will be appreciated, it is difficult to maintain the waveguide width to within the required extremely narrow tolerance due to the extreme length of the waveguide, particularly because there are sixteen waveguides which could deviate from the nominal and important broad-face width at random. In addition, a substantial support structure is necessary, which, in any event can not provide the uniformity required for a well-shaped beam. But even the support structure would not mitigate non-uniformities inherent in machining a seventeen foot waveguide. Note that the radiating slots in the waveguides are placed approximately half-wave length apart (at X-band about 1.5 cm) and any deviations from their ideal planar position causes beam distortions, which directly affect range and azimuth resolutions. Ideally, each slot must radiate from its appointed relative position within the array the correct amount of power in the correct phase, in order to produce the desired far field illumination pattern.

SUMMARY OF THE INVENTION

It is, therefore, the object of the present invention to provide an improved planar antenna array suitable for satisfying the strict requirements of SLAR applications.

In order to achieve this object, it was realized that the array itself must be its own supporting structure, and, as a consequence, that it must be machined from a single piece of metal as far as the radiating waveguides, which comprise the most important group of components, are concerned. But to have a milling machine, no matter how accurate, mill sixteen (or more) parallel seventeen-feet long waveguides in that piece of metal might avoid the neccessity for an external support structure but is likely to introduce the same or more non-uniformities that would be more difficult to correct or mitigate.

Accordingly, it is a feature of the present invention that the main component group is machined in a single slab of metal. However, instead of a small number of radiating waveguides running along the array-length, a large number of relatively short waveguides run parallel to the array width.

The machined piece of metal does not only integrally incorporate the radiating waveguides, but also has its edge serving as the key coupling-(broad side)-wall of a series-fed waveguide.

Accordingly, it is another feature of the present invention that a single feeder waveguide has a coupling wall integral with, and machined in, the main slab of metal which incorporates the radiating waveguides.

It will be appreciated by those skilled in the art, that to have all critical components of the antenna array integrally machined from a single slab of metal is advantageous.

According to the present invention there is provided a planar slotted waveguide antenna array having a front, radiating, surface and a back-plane, a length dimension L and a width dimension W, comprising:

(a) a plurality of radiating waveguides parallel to the width dimension;

(b) a plurality of co-planar radiating apertures in each of said plurality of radiating waveguides constituting said radiating surface;

(c) a feeder waveguide along at least part of the length dimension contiguous with a predetermined edge of the array; and (d) a plurality of coupling apertures for coupling microwave energy between said feeder waveguide and each of said plurality of radiating waveguides.

According to a narrower aspect of the present invention, the plurality of radiating waveguides and the pluarlity of coupling apertures are machined in a single piece of suitable metal.

BRIEF DESCRIPTION OF THE DRAWINGS

The preferred embodiment of the present invention will now be described in conjunction with the annexed drawings in which.

DETAILED DESCRIPTION OF THE PREFERRED EMBODIMENT

Figure 1:
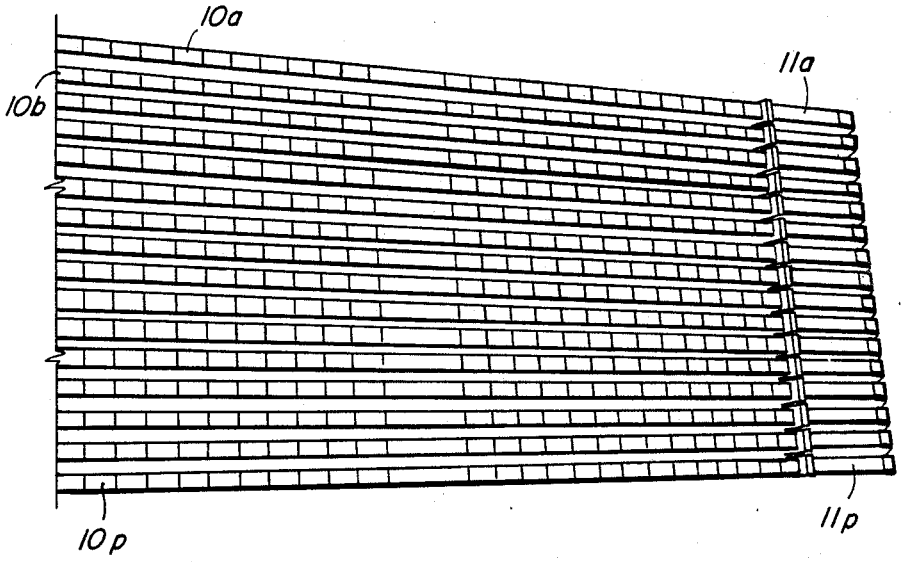
FIG. 1 (PRIOR ART)
FIG. 1 is a front perspective view of a portion of the radiating face of a prior art SLAR antenna.

FIG. 1 of the drawings shows a portion of the SLAR antenna array of the prior art. The horizontal, parallel slotted waveguide 10*a* to 10*p* continue to the left of the Figure for a total length of approximately seventeen feet. At the right edge of the Figure sixteen feeder waveguides 11*a* to 11*p* are shown, which themselves are fed via a tree of T-splitters (not shown), which is why the array comprises sixteen radiating waveguides 10*a* to 10*p*. If power is not to be wasted in dummy loads, such array must have $2^n$ radiating waveguides.

The far-field azimuth angle $\alpha$ of a radar beam is defined as the off-axis angle at which the beam intensity is $-3$ dB relative to its peak. For SLAR applications a small azimuth angular width $\alpha$ of the beam is desired, in order to increase mapping resolution in the horizontal plane along the flight path of a SLAR aircraft. The angular width $\alpha$ for the antenna of the present preferred embodiment is approximately 0.4°, which is capable of yielding an azimuth resolution of less than 8 meters/km. The side lobes of the main beam should be as low as possible and are $-25$ dB in the present case.

Figure 2:
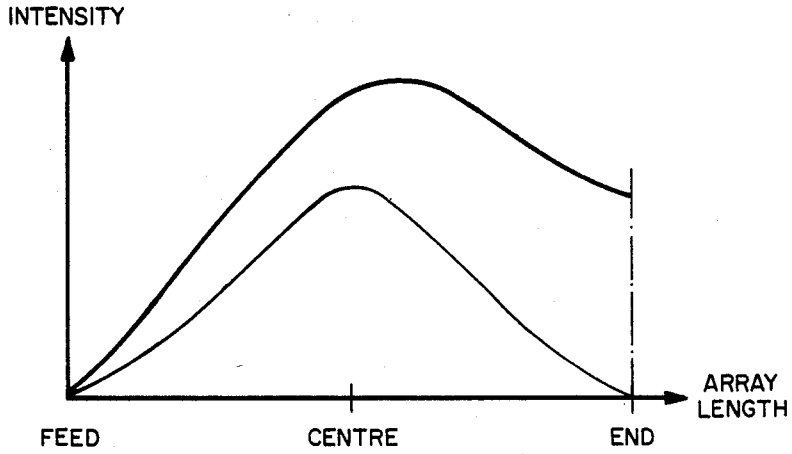
FIG. 2 is a graph illustrating power coupling, and near-field patterns of a SLAR antenna according to the present invention.

In order to achieve the desired far-field azimuth pattern, a near-field pattern as shown in FIG. 2 by the thin solid line is required. It means that along the length of the radiating antenna, maximum power is to be radiated from its central axis. A suitably smoothly tapering function for such radiation pattern is given by $$(\tfrac{2}{3})+(\tfrac{1}{3})\cos x,\ -\pi<x<\pi.$$

Thus minimum power would be radiated along the narrow (vertical) edges of the array.

The bold solid curve in FIG. 2 illustrates the power coupling coefficient from the feeder waveguide to the radiating waveguides along the length of the array of the present embodiment and will be discussed later in conjunction with FIG. 4 et seq.

Figure 3:
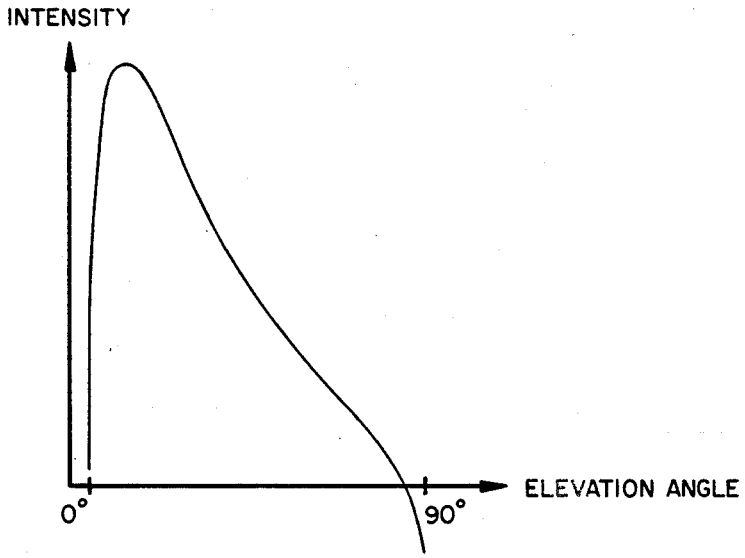
FIG. 3 is a graph illustrating the elevation intensity profile of the SLAR antenna according to the present invention.

While FIG. 2 shows the azimuth plane pattern in the near-field, FIG. 3 illustrates the desired intensity of illumination as a function of the elevation angle. In flight, the SLAR antenna hangs under the fuselage of the aircraft with its length parallel to the flight path and radiates to one side perpendicular to the path. As it is normally desired to illuminate and map, say, a 100 km swath, the intensity of illumination should be maximum at an elevation angle slightly more than the horizontal. The illumination should decline with increasing angle with the horizontal plane of the flight path and must be a null at 90°, i.e. under the aircraft, in order to prevent interference with the radiation from the antenna on the other side of the aircraft. The smoothness of the decline in radiation intensity in the elevation plane is important for the uniformity of reflection of the radiation off the terrain.

Figure 4:
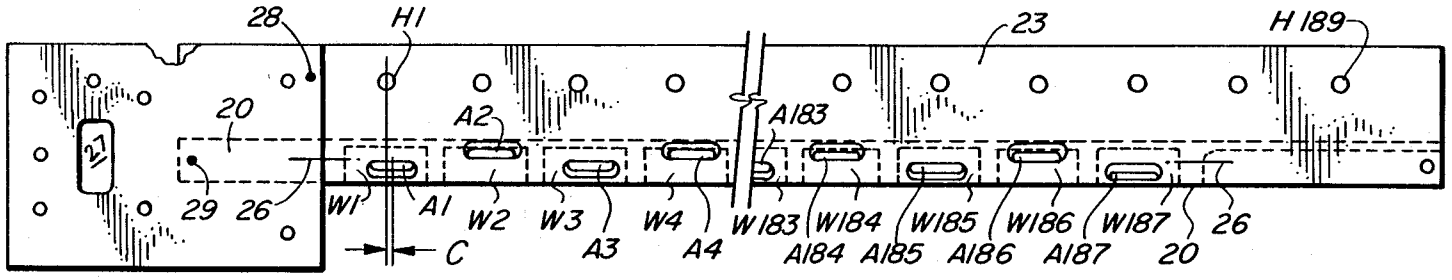
FIG. 4 is a plan view of the SLAR antenna according to the present invention without feeder waveguide.
Figure 5:
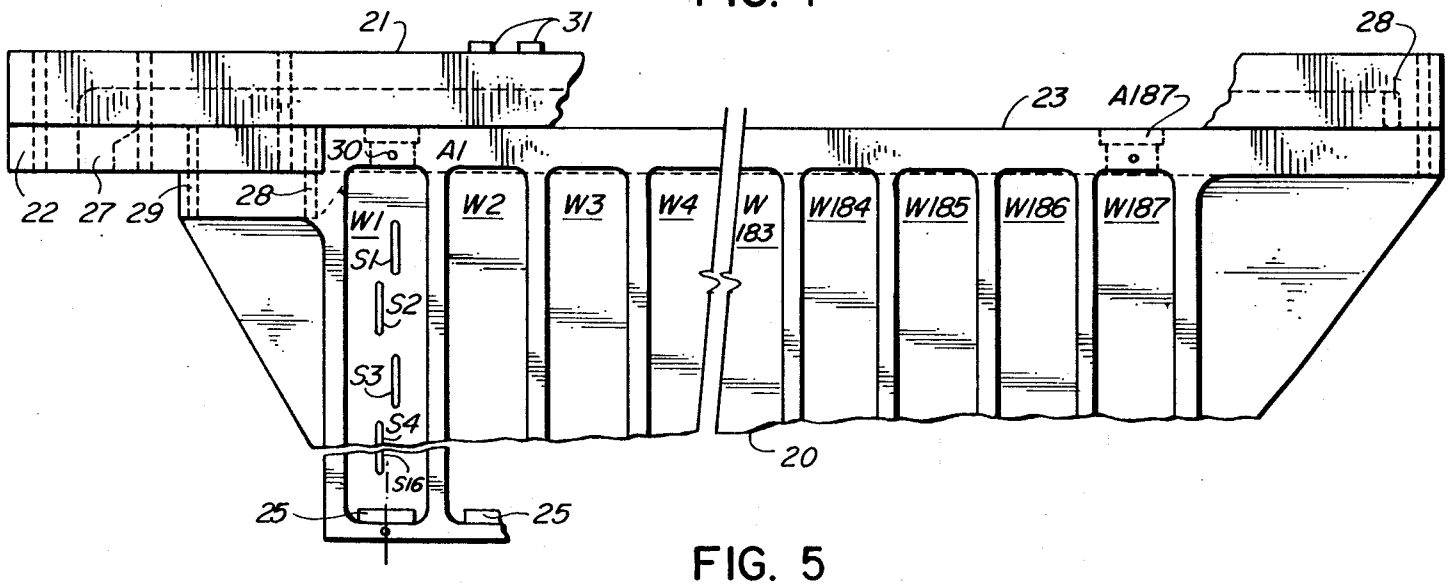
FIG. 5 is a side elevation without back-plane cover of the SLAR antenna shown in FIG. 4 with the feeder waveguide in place.

We now turn to FIGS. 4 and 5, showing the structure of the SLAR antenna array. FIG. 4 is a plan view of the antenna as it hangs vertically either below the fuselage of an aircraft (not shown) or along the side thereof. FIG. 5 is a side elevation showing the back of the antenna with the cover plate removed and not shown, and which is simply a planar rectangular piece of aluminum coextensive with the outer dimensions of the radiating waveguides, and is when assembly is complete, screwed in place by means of 6014 screws evenly spaced around the radiating waveguide cavities. The back wall thus serves as a broadside wall to the radiating waveguides and as such must be well secured thereto to ensure electrical integrity and prevent any power leakage.

Referring to FIGS. 4 and 5, the antenna is constructed from a single piece of machined (by numerically controlled milling) aluminum member 20, a back-plane cover (not shown) with a flange along its long edge, a feeder-wave-guide forming U-shaped channel 21, and a flange 22 at the feeder end of the array. The aluminum member 20 has along its length on the side of the U-shaped channel 21 a raised flange 23 serving as a fourth wall together with the flange of the back-plane cover of the wave-guide forming U-shaped channel 21. Vertical radiating waveguide cavities W1 to W187 are milled into the member 20, which in its pristine form measured more than its machined length of approximately 206 inches and its machined width of approximately 15.25 inches. Into the front wall of each of the waveguide cavities W1 to W187 are milled radiating slots S1 to S16 (shown only in the cavity W1, as are all other details) which alternate on either side of the center line 24, lengthwise, of the wall. Each waveguide cavity has an identical load constructed of microwave-absorbing material at its end, and communicates at its opposite (feed) end by means of a plurality of composite coupling apertures A1 to A187, which alternate on either side of the centre line 26 of that part of the raised flange 23 which, along its length, forms the fourth wall of the feeder waveguide forming U-shaped channel 21. But the apertures A1 to A187 (only A1 and A187 are shown in FIG. 5) are not identical, neither in dimensions nor in position with respect to the centre line 24 of the radiating waveguide cavities W1 to W187. The feeder waveguide 21 is connected to the transmit/-receive waveguide (not shown) through the flange 22 at an input/output end 27 and has a load constructed of microwave absorbing material 28 at its other end to absorb residual power and match the waveguide. Aligning dowells 28 and 29 are press fitted into place and ensure integrity of the connections to prevent leakage or discontinuities in the path of the transmit power coupled via the input/output 27. For the same reasons, it is necessary to ensure good electrical connection between the flange 23 and the waveguide channel 21, which is bolted to the flange 23 through holes H1 to H189.

In order to not clutter the drawings, details of machining instructions and other details that are considered known in the art were omitted.

ELECTRICAL DESIGN OF THE ANTENNA

As mentioned hereinabove, the antenna of the preferred embodiment was constructed to fit in the existing housings of the prior art antenna shown in FIG. 1. This fact determined that at X-band ($\lambda \approx 3$ cm) an antenna length of approximately 17 feet yields 187 radiating waveguides W1 to W187 each of which has 16 radiating slots S1 to S16, sixteen being the number of parallel waveguides in the prior art antenna, dictated by the fact that eight would be too few and thirty-two too many. In the present design, however, there is no such restriction and the antenna array could have been designed to be wider but for the housing.

A standard waveguide size for the X-band is $0.9 \times 0.4$ inches and such standard was chosen throughout for the cavities W1 to W187 as well as the feeder channel 21. The length of each cavity W1 to W187, given the permissible total antenna width, was chosen to be $25 \times (\lambda/2) = 14.66$ inches.

The design of the radiating-slot arrays S1 to S16, which are non-uniform travelling-wave arrays, follows known procedures, for example, as explained by H. Yee in Chapter 9 (Slot-Antenna Arrays) in the text "Antenna Engineering Handbook (Johson and Jasik, eds., second ed., 1984) published by McGraw-Hill. This Chapter is included herein in its entirety by reference. Reference is made particularly to Section 9-7, at p. 9–26 titled "Travelling-Wave Slot-Array Design". The resultant slot length is $0.614 \pm 0.002$ inch for all slots S1 to S16 in all cavities W1 to W187, while the width is 0.062 inch. The position of the slots S1 to S16 with reference to the centre line 24 and with reference to the feed-end of the cavities W1 to W187 is determinable following the known principles expounded in the above reference.

The design of the coupling apertures A1 to A187 is not conventional. As may be seen from FIGS. 6 and 7, the apertures A1 to A187 constrict stepwise along their central axis. This composite coupling aperture construction became necessary due to, first, the wall thickness through which coupling was necessary and which was dictated by mechanical reasons to be 0.4 inch, and, second, by the large variation in the degree of coupling required as dictated by the bold solid curve shown in FIG. 2. For in order to produce the near-field pattern above mentioned, (and given that the feeder waveguide 21 begins to feed at one end of the array of radiating waveguides at W1 and ends feeding at W187), a variation in coupling as per the bold solid curve became necessary. Normally, such variation in the degree of coupling is accomplished by placing the conventional coupling slots closer to or farther away from the centre line (as with the slots S1 to S16). But due to the mechanical constraints, among them that a hole 30 has to be provided for the back-plane cover, the apertures A1 to A187 cannot be moved too far away from their centre line to increase coupling. It was thus necessary to have a fixed spacing on either side of the centre line for all the coupling apertures A1 to A187 but make them variably shorter than the resonant length. That, however, introduces phase errors that would degrade the azimuth beam shape and increase the level of the side-lobes. In order to correct for phase errors, the apertures A1 to A187 were variably positioned off the centre line 24 at the radiating waveguides W1 to W187, by the variable dimension C in FIG. 4.

Figure 6:
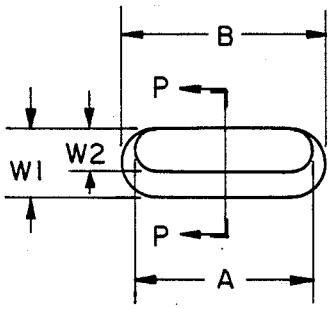
FIG. 6 is an enlargement of the feeder coupling apertures shown in FIG. 4.
Figure 7:
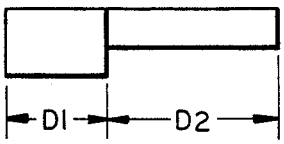
FIG. 7 is a profile of the coupling aperture shown in FIG. 6 in the plane of the axis P—P.

For the necessary variation in coupling, between −−dB and −14 dB, in the preferred embodiment, the constant dimensions of the apertures A1 to A187 as shown in FIGS. 6 and 7 are as follows:

W1=0.188 inch ±0.005
W2=0.100 inch ±0.005
D1=0.140 inch (D1 should be as long as possible)
D2=0.260 inch.

The variable dimensions A, B (in FIG. 6) and C (in FIG. 4) for each of the apertures A1 to 187 are given in the table on the following pages.

In order to compensate for deviation from the nominal broad-face width of the feeder waveguide 21, which would affect the propagation velocity in the guide, it is preferable to employ pairs of adjustable screws penetrating the broad face of the waveguide. Suitable special purpose screws are commercially available from a number of suppliers, one of these being Johanson. "Johanson screws" consist of an insert comprising a plated screw, threaded bushing, and locking device. 31 are needed along the outside broad wall thereof to compensate for such deviation from nominal waveguide velocity, which, of course, affects the phase. It is for this reason that the employment of a single 17 feet-long waveguide is advantageous. For it is very difficult to compensate in the prior SLAR antenna and attain uniformity among sixteen very long waveguides.

| SLOT NO. | "A" DIM | "B" DIM | "C" DIM |
|---|---|---|---|
| 1 | 0.480 | 0.558 | +0.083 |
| 2 | 0.480 | 0.558 | +0.083 |
| 3 | 0.481 | 0.559 | +0.083 |
| 4 | 0.481 | 0.559 | +0.083 |
| 5 | 0.481 | 0.559 | +0.083 |
| 6 | 0.482 | 0.560 | +0.083 |
| 7 | 0.482 | 0.560 | +0.083 |
| 8 | 0.483 | 0.561 | +0.083 |
| 9 | 0.483 | 0.561 | +0.083 |
| 10 | 0.484 | 0.562 | +0.083 |
| 11 | 0.085 | 0.563 | +0.083 |
| 12 | 0.486 | 0.564 | +0.083 |
| 13 | 0.487 | 0.565 | +0.083 |
| 14 | 0.488 | 0.566 | +0.083 |
| 15 | 0.489 | 0.567 | +0.083 |
| 16 | 0.490 | 0.568 | +0.083 |
| 17 | 0.491 | 0.569 | +0.083 |
| 18 | 0.493 | 0.571 | +0.083 |
| 19 | 0.494 | 0.572 | +0.083 |
| 20 | 0.496 | 0.574 | +0.082 |
| 21 | 0.497 | 0.575 | +0.082 |
| 22 | 0.499 | 0.577 | +0.082 |
| 23 | 0.501 | 0.579 | +0.082 |
| 24 | 0.502 | 0.580 | +0.082 |
| 25 | 0.504 | 0.582 | +0.082 |
| 26 | 0.506 | 0.584 | +0.082 |
| 27 | 0.508 | 0.586 | +0.082 |
| 28 | 0.510 | 0.588 | +0.081 |
| 29 | 0.512 | 0.590 | +0.081 |

-continued

| SLOT NO. | "A" DIM | "B" DIM | "C" DIM |
|---|---|---|---|
| 30 | 0.514 | 0.592 | +0.081 |
| 31 | 0.516 | 0.594 | +0.081 |
| 32 | 0.517 | 0.595 | +0.080 |
| 33 | 0.519 | 0.597 | +0.080 |
| 34 | 0.521 | 0.599 | +0.080 |
| 35 | 0.523 | 0.601 | +0.080 |
| 36 | 0.525 | 0.603 | +0.079 |
| 37 | 0.527 | 0.605 | +0.079 |
| 38 | 0.528 | 0.606 | +0.079 |
| 39 | 0.530 | 0.608 | +0.078 |
| 40 | 0.531 | 0.609 | +0.078 |
| 41 | 0.533 | 0.611 | +0.078 |
| 42 | 0.534 | 0.612 | +0.077 |
| 43 | 0.535 | 0.613 | +0.077 |
| 44 | 0.535 | 0.613 | +0.076 |
| 45 | 0.536 | 0.614 | +0.076 |
| 46 | 0.536 | 0.614 | +0.075 |
| 47 | 0.537 | 0.615 | +0.075 |
| 48 | 0.538 | 0.616 | +0.074 |
| 49 | 0.539 | 0.617 | +0.074 |
| 50 | 0.541 | 0.619 | +0.073 |
| 51 | 0.542 | 0.620 | +0.073 |
| 52 | 0.543 | 0.621 | +0.072 |
| 53 | 0.544 | 0.622 | +0.072 |
| 54 | 0.545 | 0.623 | +0.071 |
| 55 | 0.546 | 0.624 | +0.071 |
| 56 | 0.547 | 0.625 | +0.070 |
| 57 | 0.548 | 0.626 | +0.069 |
| 58 | 0.549 | 0.627 | +0.069 |
| 59 | 0.550 | 0.628 | +0.068 |
| 60 | 0.551 | 0.629 | +0.067 |
| 61 | 0.551 | 0.630 | +0.067 |
| 62 | 0.552 | 0.630 | +0.066 |
| 63 | 0.552 | 0.630 | +0.066 |
| 64 | 0.552 | 0.630 | +0.065 |
| 65 | 0.552 | 0.630 | +0.064 |
| 66 | 0.552 | 0.630 | +0.063 |
| 67 | 0.552 | 0.630 | +0.063 |
| 68 | 0.553 | 0.631 | +0.062 |
| 69 | 0.554 | 0.632 | +0.061 |
| 70 | 0.554 | 0.632 | +0.060 |
| 71 | 0.555 | 0.633 | +0.059 |
| 72 | 0.555 | 0.633 | +0.058 |
| 73 | 0.556 | 0.634 | +0.057 |
| 74 | 0.556 | 0.634 | +0.056 |
| 75 | 0.557 | 0.635 | +0.055 |
| 76 | 0.557 | 0.635 | +0.053 |
| 77 | 0.557 | 0.635 | +0.052 |
| 78 | 0.558 | 0.636 | +0.051 |
| 79 | 0.558 | 0.636 | +0.050 |
| 80 | 0.559 | 0.637 | +0.048 |
| 81 | 0.559 | 0.637 | +0.046 |
| 82 | 0.560 | 0.638 | +0.044 |
| 83 | 0.560 | 0.638 | +0.042 |
| 84 | 0.561 | 0.639 | +0.040 |
| 85 | 0.561 | 0.639 | +0.038 |
| 86 | 0.562 | 0.640 | +0.036 |
| 87 | 0.562 | 0.640 | +0.033 |
| 88 | 0.563 | 0.641 | +0.031 |
| 89 | 0.563 | 0.641 | +0.028 |
| 90 | 0.564 | 0.642 | +0.025 |
| 91 | 0.564 | 0.642 | +0.022 |
| 92 | 0.565 | 0.643 | +0.019 |
| 93 | 0.565 | 0.643 | +0.016 |
| 94 | 0.566 | 0.644 | +0.013 |
| 95 | 0.566 | 0.644 | +0.009 |
| 96 | 0.567 | 0.645 | +0.006 |
| 97 | 0.567 | 0.645 | +0.002 |
| 98 | 0.568 | 0.646 | −0.001 |
| 99 | 0.568 | 0.646 | −0.005 |
| 100 | 0.569 | 0.647 | −0.009 |
| 101 | 0.569 | 0.647 | −0.012 |
| 102 | 0.570 | 0.648 | −0.013 |
| 103 | 0.570 | 0.648 | −0.015 |
| 104 | 0.571 | 0.649 | −0.017 |
| 105 | 0.572 | 0.650 | −0.019 |
| 106 | 0.572 | 0.650 | −0.020 |
| 107 | 0.573 | 0.651 | −0.022 |
| 108 | 0.573 | 0.651 | −0.023 |
| 109 | 0.574 | 0.652 | −0.024 |
| 110 | 0.574 | 0.652 | −0.026 |

-continued

| SLOT NO. | "A" DIM | "B" DIM | "C" DIM |
|---|---|---|---|
| 111 | 0.575 | 0.653 | −0.027 |
| 112 | 0.575 | 0.653 | −0.028 |
| 113 | 0.576 | 0.654 | −0.029 |
| 114 | 0.576 | 0.654 | −0.030 |
| 115 | 0.577 | 0.655 | −0.031 |
| 116 | 0.577 | 0.655 | −0.031 |
| 117 | 0.578 | 0.656 | −0.032 |
| 118 | 0.058 | 0.656 | −0.032 |
| 119 | 0.579 | 0.657 | −0.033 |
| 120 | 0.579 | 0.657 | −0.033 |
| 121 | 0.580 | 0.658 | −0.034 |
| 122 | 0.580 | 0.658 | −0.934 |
| 123 | 0.581 | 0.659 | −0.034 |
| 124 | 0.580 | 0.659 | −0.035 |
| 125 | 0.581 | 0.659 | −0.035 |
| 126 | 0.582 | 0.660 | −0.035 |
| 127 | 0.582 | 0.660 | −0.035 |
| 128 | 0.582 | 0.660 | −0.035 |
| 129 | 0.582 | 0.660 | −0.036 |
| 130 | 0.583 | 0.661 | −0.036 |
| 131 | 0.583 | 0.661 | −0.036 |
| 132 | 0.583 | 0.661 | −0.037 |
| 133 | 0.583 | 0.661 | −0.037 |
| 134 | 0.584 | 0.662 | −0.037 |
| 135 | 0.584 | 0.662 | −0.037 |
| 136 | 0.584 | 0.662 | −0.037 |
| 137 | 0.584 | 0.662 | −0.937 |
| 138 | 0.584 | 0.662 | −0.037 |
| 139 | 0.584 | 0.662 | −0.037 |
| 140 | 0.584 | 0.662 | −0.037 |
| 141 | 0.584 | 0.662 | −0.037 |
| 142 | 0.584 | 0.662 | −0.038 |
| 143 | 0.584 | 0.662 | −0.038 |
| 144 | 0.584 | 0.662 | −0.038 |
| 145 | 0.584 | 0.662 | −0.037 |
| 146 | 0.584 | 0.662 | −0.037 |
| 147 | 0.584 | 0.662 | −0.037 |
| 148 | 0.584 | 0.662 | −0.037 |
| 149 | 0.584 | 0.662 | −0.037 |
| 150 | 0.584 | 0.662 | −0.037 |
| 151 | 0.583 | 0.661 | −0.037 |
| 152 | 0.583 | 0.661 | −0.036 |
| 153 | 0.583 | 0.661 | −0.036 |
| 154 | 0.583 | 0.661 | −0.036 |
| 155 | 0.583 | 0.661 | −0.036 |
| 156 | 0.582 | 0.660 | −0.035 |
| 157 | 0.582 | 0.660 | −0.035 |
| 158 | 0.582 | 0.660 | −0.035 |
| 159 | 0.582 | 0.660 | −0.035 |
| 160 | 0.581 | 0.659 | −0.035 |
| 161 | 0.581 | 0.659 | −0.035 |
| 162 | 0.581 | 0.659 | −0.035 |
| 163 | 0.580 | 0.658 | −0.034 |
| 164 | 0.580 | 0.658 | −0.034 |
| 165 | 0.580 | 0.658 | −0.034 |
| 166 | 0.580 | 0.658 | −0.034 |
| 167 | 0.579 | 0.657 | −0.034 |
| 168 | 0.579 | 0.657 | −0.034 |
| 169 | 0.579 | 0.657 | −0.033 |
| 170 | 0.579 | 0.657 | −0.033 |
| 171 | 0.579 | 0.657 | −0.033 |
| 172 | 0.579 | 0.657 | −0.033 |
| 173 | 0.579 | 0.657 | −0.033 |
| 174 | 0.579 | 0.657 | −0.033 |
| 175 | 0.579 | 0.657 | −0.033 |
| 176 | 0.579 | 0.657 | −0.034 |
| 177 | 0.580 | 0.658 | −0.034 |
| 178 | 0.580 | 0.658 | −0.034 |
| 179 | 0.581 | 0.659 | −0.035 |
| 180 | 0.581 | 0.659 | −0.035 |
| 181 | 0.582 | 0.660 | −0.035 |
| 182 | 0.583 | 0.661 | −0.036 |
| 183 | 0.584 | 0.662 | −0.037 |
| 184 | 0.585 | 0.663 | −0.038 |
| 185 | 0.586 | 0.664 | −0.039 |
| 186 | 0.587 | 0.665 | −0.040 |
| 187 | 0.588 | 0.666 | −0.040 |

The composite coupling aperture (such as A1 to A187) and the method of its design are subject of concurrently filed patent application entitled "Composite Waveguide Coupling Aperture Having a Thickness Dimension" by the same inventor.

The embodiments of the invention in which an exclusive property or privilege is claimed are defined as follows:

1. A planar slotted waveguide antenna array having a front, radiating, surface and a back-plane, a length dimension L and a width dimension W, comprising:

(a) a plurality of radiating waveguides parallel to the width dimension;

(b) a plurality of co-planar radiating apertures in each of said plurality of radiating waveguides constituting said radiating surface;

(c) a feeder waveguide along at least part of the length dimension contiguous a predetermined edge of the array;

(d) a plurality of coupling apertures for coupling microwave energy between said feeder waveguide and each of said plurality of radiating waveguides; and (e) wherein the plurality of radiating waveguides and the plurality of coupling apertures are machined in a single piece of suitable metal.

2. The planar slotted waveguide antenna array as defined in claim 1, having machined in said single piece of metal along a predetermined side of the length dimension a coupling wall of said feeder waveguide.

3. The planar slotted waveguide antenna array as defined in claim 2, said plurality of coupling apertures alternating in a predetermined manner on either side of the longitudinal axis of said feeder waveguide.

4. The planar slotted waveguide antenna array as defined in claim 2, wherein a slab of aluminum is machined to provide three walls of each one of said plurality of radiating waveguides, and wherein each of said plurality of coupling apertures is machined into the edge of said slab of aluminum along said length dimension.

5. The planar slotted waveguide antenna array as defined in claim 1, said plurality of coupling apertures alternating in a predetermined manner on either side of the longitudinal axis of said feeder waveguide.

6. The planar slotted waveguide antenna array as defined in claim 1, said plurality of coupling apertures alternating in a predetermined manner on either side of the longitudinal axis of said feeder waveguide.

7. The planar slotted waveguide antenna array as defined in claim 1, wherein a slab of aluminum is machined to provide three walls of each one of said plurality of radiating waveguides, and wherein each of said plurality of coupling apertures is machined into the edge of said slab of aluminum along said length dimension.

8. The planar slotted waveguide antenna array as defined in claim 1, wherein a slab of aluminum is machined to provide three walls of each one of said plurality of radiating waveguides, and wherein each of said plurality of coupling apertures is machined into the edge of said slab of aluminum along said length dimension.

* * * * *